US005421283A

United States Patent [19]

Bruggemann et al.

[11] Patent Number: 5,421,283

[45] Date of Patent: Jun. 6, 1995

[54] LIGHTWEIGHT BOAT CONSTRUCTION

[76] Inventors: Kimber R. Bruggemann; Michael R. Rose, both of 815 Hwy. 93 South, Hamilton, Mont. 59840

[21] Appl. No.: 275,406

[22] Filed: Jul. 15, 1994

[51] Int. Cl.[6] ..... B63B 5/24

[52] U.S. Cl. ..... 114/357; 114/68; 441/35

[58] Field of Search ..... 114/65 R, 355, 357, 114/266, 267, 263, 352–354, 363, 68; 441/74, 129, 130, 35, 43

[56] References Cited

U.S. PATENT DOCUMENTS

| | | | |
|---|---|---|---|
| 2,866,985 | 1/1959 | Blackmore | 9/6 |
| 3,497,887 | 3/1970 | Bureau, Jr. | 114/357 |
| 3,620,027 | 11/1971 | Nordell | 114/266 |
| 3,928,691 | 12/1975 | Knudson | 114/355 |
| 4,337,544 | 7/1982 | Coulter et al. | 114/357 |
| 4,517,911 | 5/1985 | Seefeld | 114/267 |
| 4,662,303 | 5/1987 | Duff | 114/343 |
| 4,730,569 | 3/1988 | Colson | 114/43 |
| 4,827,859 | 5/1989 | Powell | 114/61 |
| 5,061,215 | 10/1991 | Walls | 441/45 |

FOREIGN PATENT DOCUMENTS

| | | | |
|---|---|---|---|
| 3423020 | 1/1986 | Germany | 114/267 |

*Primary Examiner*—Edwin L. Swinehart
*Attorney, Agent, or Firm*—Foley & Lardner

[57] ABSTRACT

A lightweight boat construction in which the main body is formed of top and bottom sheets of lightweight floatable plastic material. The sheets are configured externally to provide the desired external boat configuration when the sheets are superimposed and bonded. One of the bottom and top sheets is formed with a frame-receiving channel in the surface thereof contiguous the other sheet, and a PVC pipe frame is mounted in the channel for stabilizing and reinforcing the boat construction. The sheets with the embedded PVC frame are then bonded together to form the reinforced boat. Openings or recesses can be formed in the top sheets or both sheets to provide footwells, storage and battery compartments, and the like.

8 Claims, 2 Drawing Sheets

LIGHTWEIGHT BOAT CONSTRUCTION

BACKGROUND OF THE INVENTION

The present invention relates as indicated to a lightweight boat construction, and relates more particularly to a boat constructed primarily of buoyant, expanded polymer material, appropriately reinforced to strengthen and stabilize the same, and a method for making the boat.

The use of lightweight buoyant plastic foam, for example, styrofoam or comparable materials, is known in the art. For example, U.S. Pat. No. 2,866,985 discloses a boat made of buoyant plastic foam specifically designed for use by children and teenagers, and appropriately sized for that purpose. U.S. Pat. No. 4,662,303 discloses a fishing boat which is partially constructed of a positive flotation foam material, encased in metal to form a deck and keel construction. U.S. Pat. No. 4,827,859 discloses a fishing boat made of a single piece of expanded copolymer material formed to provide two distinct pontoons and a connecting panel, with the pontoons at the front of the boat being secured together by a tie rod. U.S. Pat. No. 4,517,911 also discloses a pontoon boat in which spaced pontoons are filled with a closed cell foam material, with the walls of the pontoon and the deck being formed from sheet aluminum.

SUMMARY OF THE INVENTION

The invention is particularly characterized by its lightweight yet stable and rugged construction capable of carrying two adults comfortably for fishing or other recreational purposes. The boat is primarily constructed of expanded cellular plastic material such as styrofoam, suitably stabilized and reinforced by a frame member positioned or embedded within the foam material. The frame member provides not only reinforcement but protection at the bow and stern of the boat, and includes upwardly directed oarlocks at the sides of the boat in approximately the center region thereof to receive the pins of oars by means of which the boat can be propelled. A motor mount is provided either at the bow or stern of the boat for mounting a trolling motor.

The boat construction of the present invention is easy to fabricate and is inexpensive to manufacture. The major components are commercially available items, with the frame of the boat being shaped from two sheets of styrofoam each approximately four feet wide and eight feet long, and six inches thick. The styrofoam can be easily shaped exteriorly to provide the desired configuration to the boat, and can be shaped, or material entirely removed, to provide additional features. The boat can be constructed, with little variation, to accommodate one or two persons, with the latter additionally being formed with a passenger seat and recessed compartment for receiving the feet of the passenger. A similar compartment for the operator, or the only compartment in the case of a boat constructed for use by one person, is comprised of aligned openings formed in both the upper and lower sheets of styrofoam, with a pan-like container or crate being supported in the openings in order to accommodate the feet of the user or permit the user to stand up in the boat. Such crate can be easily removed thereby providing an open section through the middle of the boat by means of which the user can carry the boat through poor navigational areas, or to and from transportation. The boat can be conveniently carried by the frame members forming the oarlocks.

A further feature of the invention is the provision of one or more seats elevated above the main surface of the upper sheet and formed from material removed from the sheet or sheets during the formation of the central opening and the passenger opening or recess. The seats can be bonded to the surface of the upper sheet. Other smaller openings such as openings for storage compartments and a battery to start the trolling motor can be additionally provided, as desired or necessary. All of the recesses or openings formed in one or both of the plastic sheets can be quickly and easily cut with conventional tools.

The basic objectives of the invention are achieved by providing separate bottom and top sheets of lightweight floatable plastic material. Both sheets are formed with openings extending through the full thickness of the sheets for either accommodating a crate or container in which the operator of the boat can place his feet when the boat is propelled manually by oars, or by a propelling motor, with the crate or container being removed to provide a through-opening accommodating the user when it is desired to carry the boat. The bottom and top sheets are shaped or configured externally to provide the desired external shape, and at least one of the sheets is formed on the contiguous face thereof with a channel in which is mounted a frame for reinforcing and stabilizing the boat construction. The frame is preferably in the form of connected plastic pipe, which in accordance with the preferred construction extends outwardly at the stern and bow of the boat to provide added protection, and extends upwardly to either side of the central opening to provide oarlocks. Following installation of the frame, the upper sheet is positioned over the bottom sheet and bonded thereto, thereby providing an integral construction in which the frame is embedded. Openings for storage compartments and the battery are preferably formed in the top sheet prior to assembly, and seats for the user and a passenger, in the case of the two man boat, can be secured to the upper sheet by bonding following the assembly described.

A further feature of the invention is its inexpensive manufacture. The bottom and top sheets of buoyant foamed plastic relatively inexpensive and are cut and shaped to provide the desired exterior configuration to facilitate navigation, and openings for foot access, passenger access, battery and storage. The sections cut and removed can be used for seats for the user and passenger, in the case of the two man boat, and these seat sections can be bonded to the upper, surface of the top sheet. Any additional components such as containers or crates for foot areas, or wood for the motor mount, are likewise inexpensive. Commercially available protective sheets are applied to the bottom and lower sides of the boat for protection against ice, rocks, or the like, and the entire exposed top half of the boat is preferably coated with a resin material to provide a protective coating. The frame is preferably formed of 1" diameter PVC pipe commercially available at relatively low cost, as are the necessary fittings and connections required to properly shape the frame.

A further feature and advantage of the invention is the simplicity of manufacture. The sequence of manufacturing steps are generally noted above, and the necessary configuring of the top and bottom styrofoam sheets can be done quickly and easily with the requisite precision. The same applies to openings or recesses provided by removing material from the sheets to provide the features described. The plastic pipe is purchased in commercially available lengths, and can be quickly cut to specifications, and thereafter connected and positioned in the channel provided therefor in the bottom sheet. After the sheets are shaped and the openings and recesses formed, the top sheet can be bonded to the lower sheet with the pipe frame imbedded therebetween. The protective sheet can then be bonded to the bottom of the boat, and a protective coating applied to the exposed upper portions of the boat. The battery, storage compartments, and crates or containers for the foot areas can then be installed, together with the motor mount and plywood trim members around the piping extending upwardly to form the oarlocks.

These and other objects and features of the invention will become apparent as the following description proceeds in particular reference to the application drawings.

BRIEF DESCRIPTION OF THE DRAWINGS

In the application drawings.

DETAILED DESCRIPTION OF THE PREFERRED EMBODIMENTS

Figure 1:
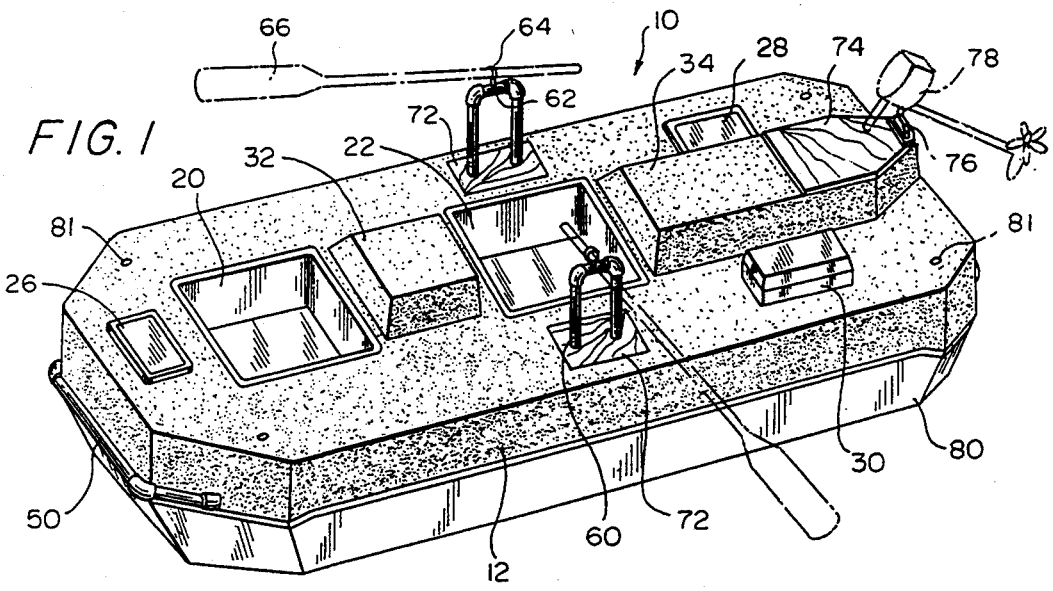
FIG. 1 is a perspective view of an assembled two man boat constructed in accordance with the present invention.

Referring now in more detail to the application drawings, and initially to the two man boat construction illustrated in FIGS. 1–4, 6 and 7, the assembled boat is generally indicated at 10 in FIG. 1. The body of the boat is formed mainly from an upper sheet 12 of foamed plastic material such as styrofoam, and a lower sheet 14 formed of the same material. The sheets are commercially available from a number of sources and are available in various sizes. For the present invention, the preferred size is four feet in width, eight feet in length, and six inches in thickness. The boat body is cut or configured from the sheets, with templates conveniently being utilized to properly position and dimension openings and recesses formed in one or both of the sheets. In the preferred construction mode, a top template is located on the top sheet and the necessary cuts or openings made. A similar template is positioned over the bottom sheet, and properly spaced cuts and openings made in the bottom sheet. For example, it will be noted that all corners of both the top and bottom sheets are cut to provide a more rounded appearance, with the bottom sheet being additionally cut at the bow and stern, and also along the sides to a lesser degree, to form the bottom surface of the boat of the desired configuration, reference being made to FIGS. 3, 4, 6 and 7.

Figure 3:
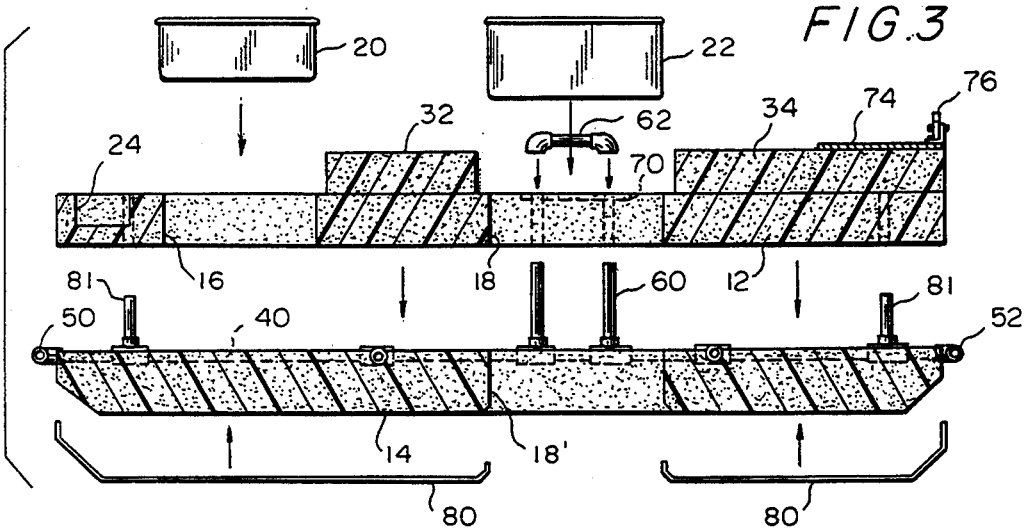
FIG. 3 is an exploded, cross sectional view taken along line 3—3 of FIG. 2, showing in more detail the configured top and bottom foam plastic sheets and other components included in the boat construction.

As perhaps best shown in FIG. 3, the top sheet 12 is formed with two openings extending through the thickness of the sheet, front opening 16 closer to the bow of the assembled boat, and central opening 18. The front opening 16 is adapted to receive a preferably plastic crate or pan 20 provided with a top flange engageable with the top surface of the sheet surrounding the opening 16. The depth of the crate 20 is preferably equal to or slightly less than the thickness of the sheet 12 so that when the sheets are assembled, the crate 20 does not engage the upper surface of the bottom sheet.

The crate 22 designed for the central opening 18 is similarly provided with a top flange engageable with the surface of the top sheet surrounding the opening 18, but crate 22 is sufficiently deep to extend below the bottom surface of sheet 12 when positioned in the opening. In order to accommodate this greater depth, the bottom sheet is formed with an opening 18' of the same dimension and extending entirely through the thickness of the bottom sheet 14. The crate 22 thus provides a deeper foot area for receiving the feet of the user or oarsman when operating the boat.

The crates 20 and 22 are commercially available, and crates manufactured by Rubbermaid Corporation have proved highly satisfactory in use. If desired, reinforcing flanges, for an example, angled aluminum, can be applied to the areas on the top surface of the sheet 12 surrounding the openings 16 and 18 to provide better support for the crates when positioned in the openings. The crates are preferably dropped in place and are not bonded or otherwise secured in the openings so as to be removable. This is particularly important with respect to crate 22 which, when removed, exposes aligned openings 18 and 18' through the entire thickness of the boat. Thus, when the lightweight boat construction is required to traverse water too shallow for manual or motor navigation, the crate 22 can be removed and the user can stand in the aligned openings for carrying the boat through the impassable areas. When navigable waters are reached, the crate 22 can again be positioned in the aligned openings to serve as a footwell during operation of the boat.

Other openings as needed can be formed in the top sheet of the boat. For example, an opening 24 is shown cut near the bow of the boat to receive a storage container 26, illustrated in FIG. 1. A similar storage container 28, FIG. 1, can be positioned in an opening provided therefor (not shown) near the stern of the boat. Similarly, an opening is formed on the port side of the stern section of the boat to receive a battery box 30 for receiving a battery for starting the trolling motor and providing current to meet other possible needs. The battery box 30 is a commercially available item and per se forms no part of the present invention.

The foam material removed from the sheets 12 and 14 when cutting the openings 16, 18 and 18' can be conveniently used for seats 32 and 34. Seat 32 is positioned between the crates 20 and 22 and forms a passenger seat, and seat 34 provides not only a seat for the operator of the boat but also a platform for mounting the trolling motor. Seat 34 is preferably formed by using end to end, the sheet sections resulting from the cutting out of openings 18 and 18', with the adjacent edges being abutted and bonded.

Templates are again preferably used to obtain the desired final configuration for the seats, and it will be noted that both seats are beveled at least at the sides thereof, with the rear seat 34 also being beveled at the stern end thereof where the boat mount is secured. The seats 32 and 34 can thus be provided without additional material cost.

Other than configuring the side edges and cutting the central opening 18', the only further modification required in the bottom sheet 14 is to cut a channel for the reinforcing frame. Such frame comprises a plurality of pipe sections commonly designated at 40 (see FIG. 4) which are assembled with connectors 42, T-fittings, 44, and elbows 46 to form a frame having the desired configuration. The frame is preferably constructed of plastic PVC pipe 1" in diameter, commercially purchased from any number of sources under the designation Schedule #40. The frame is assembled from the various pipe sections and fittings with a PVC glue, widely available commercially for that purpose. Although 1" PVC has proven satisfactory in use, it will be understood that PVC pipe slightly larger in diameter could also be used. In either case, a channel is cut in the top surface of the bottom sheet 14 to accommodate the pipe, with the depth of the channel being such that the top of the pipe is at or slightly below the top surface of the bottom sheet so as not to impair the bonding of the top sheet 12 to the bottom sheet 14 during the assembly process.

Figure 2:
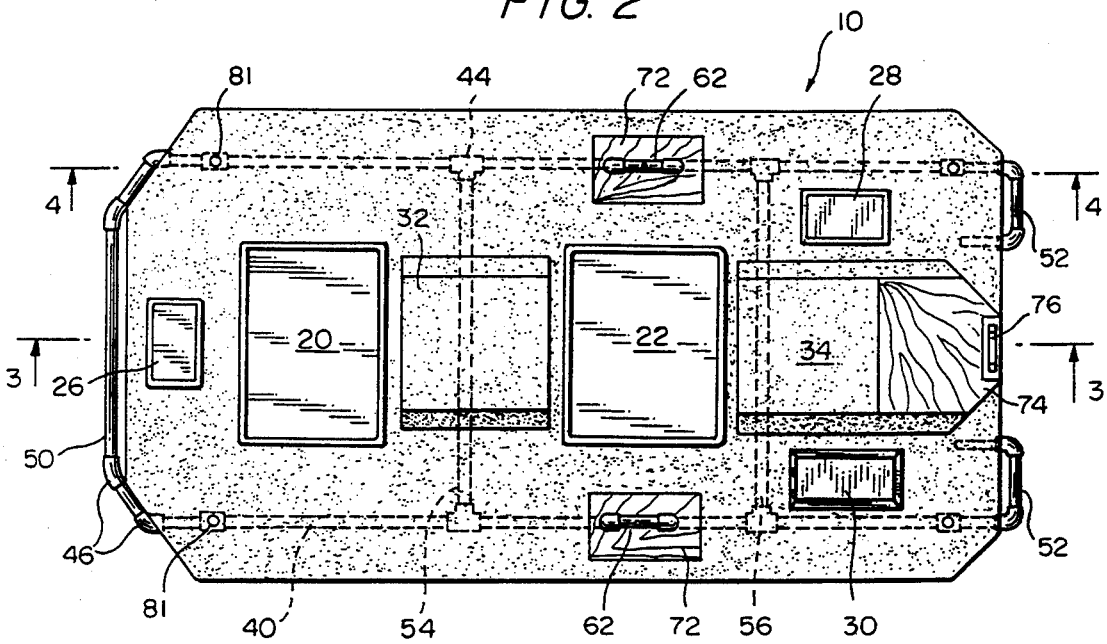
FIG. 2 is a top plan view of the boat shown in FIG. 1.

The preferred configuration of the PVC reinforcing frame is perhaps best shown in FIG. 2. Prior to assembling, the pipe sections are cut in the desired length to accommodate, when assembled, the final configuration. Sections extend longitudinally at both sides of the boat, and extend outwardly from the bow of the boat to provide a front protective guard 50. Sections also extend outwardly of the boat at the stern thereof to provide spaced protective guards 52. The guards 50 and 52 also constitute handles for lifting and carrying the boat. Crossframe pieces 54 and 56 are provided beneath the regions of the seat sections 32 and 4 in front of and behind the central opening 18 receiving the crate 22, to provide transverse reinforcement in those regions. Transverse reinforcement is provided at the bow end by the protective guard 50, and the protective guard sections 52 provide some degree of transverse reinforcement at the stern end of the boat when the top and bottom sheets are assembled.

Figure 4:
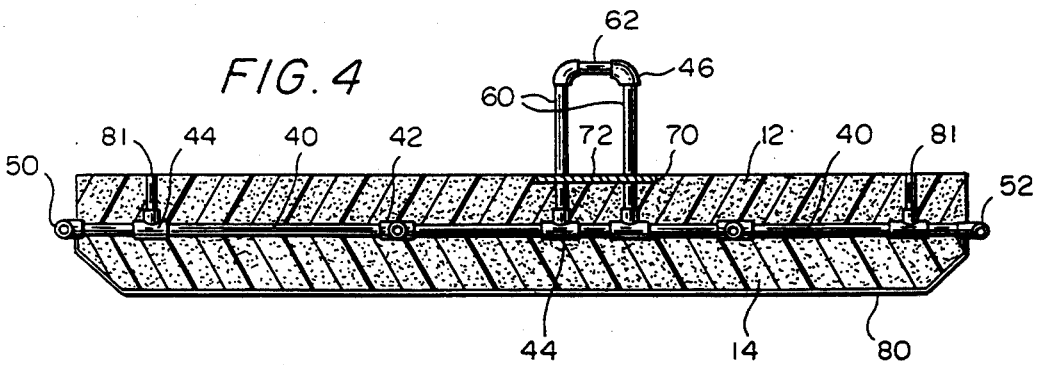
FIG. 4 is a sectional view taken on line 4—4 of FIG. 2.

Referring to FIGS. 3 and 4, pipe sections commonly designated at 60 extend upwardly from T-fittings 44 and are joined at the top by lateral pipe section 62 and elbow fittings 46. Each assembly forms an oarlock located on both sides of crate 22. The connecting pipes 62 are formed with openings to receive pins 64 secured to oars shown in dash lines at 66. The oarlocks thus adapt the boat for manual propulsion.

To stabilize the oarlocks at the top surface of the top sheet 12, a recess 70 for each oarlock assembly is formed in the surface of the sheet. Such recess can be conveniently formed by the application of heat to the foam, for example, by means of a hot iron. Wood trim members commonly designated at 72 fit into the recesses 70, with the trim pieces being formed, for example, from plywood or the like. The recesses are of a depth to accommodate the trim members so that the top surfaces thereof are flush with the adjoining surfaces of the top sheet 12. The trim members 72 are formed with openings adapted to be aligned with the upstanding pipe members 60, and the trim members can be positioned over the pipe members 60 prior to assembling the top pipe section 62 and the connecting elbows. The trim member 72 can be bonded in place if desired to secure the installation.

To accommodate a motor mount, a wood reinforcement member 74 is secured to the top surface of the seat 34 near the stern end, and bonded or otherwise secured to the seat. A motor mount 76 is attached to the reinforcing member 74, with the motor mount being adapted to receive mounting flanges or the like forming part of the motor schematically shown at 78. The motor mount 76 is commercially available and serves to pivotally mount the motor in normal fashion. The motor mount and motor flange assembly of the motor have accordingly not been shown in detail.

In order to seal the bottom of the boat, a protective shield is bonded to the bottom and side regions of the bottom sheet 14. The protective shield is diagrammatically illustrated in FIG. 3 at 80, and preferably comprises a commercially available product sold by Grace Construction Products under the product designation "Grace Ice and Water Shield." The shield material is sold in rolls 3 feet in width with an adhesive bonding on one side of the sheet and a wax paper backing sheet applied to the coating surface. To apply the sheet material, the backing is simply removed and the sheet material applied to the surface to be protected, in this case, the bottom and sides of the sheet 14 forming the bottom of the boat. The sheet ms cut as necessary to accommodate corners and other surface irregularities in order to provide a smooth shield surface. In the preferred installation, a 3 foot section is applied along one side of the boat and adjacent side, and a second roll section applied on the opposite side of the boat, with a 3" lap joint at the center. The sheet material is cut and applied so to extend upwardly into the center opening formed by the aligned openings 18 and 18', thereby providing a protective lining for the openings. The sheet 80 serves primarily as protection against deterioration or damage from water and ice.

The protective shield material 80 can also be used to provide a chafe strip (not shown) along the side of the boat, and in such event one or more layers can be applied to provide added protection in such area.

In order to accommodate a canopy which can be positioned over the boat to provide protection, relatively short pipe sections 81 (FIG. 4) extend upwardly from T-fittings 44 from the main plane of the pipe frame, terminating at the surface of the top sheet 12. As shown in FIGS. 1 and 2, pipe sections 81 are provided adjacent to each corner of the frame, and openings are formed in the top sheet 12 to accommodate the pipes. If desired, the pipes can be bonded in the openings during assembly. The pipe sections 81 permit a canopy to be conveniently installed on the boat, with the legs of the canopy extending into the pipe sections to removably mount the canopy.

To bond the top sheet 12 to the bottom sheet 14, and to bond the seats 32 and 34 to the top sheet 12, an elastic bonding material sold under the trade name "Pitt Flex" is preferably used, although other satisfactory bonding materials could also be used. The bonding material is rolled or brushed onto one or both of the surfaces to be bonded, with the bonding taking place at room temperature. For bonding the wood the trim strips 72 and the motor mount 74 to the styrofoam, a bonding material sold by Chemrex Inc. under the trade name "PL 300" is preferably used. This material can also be used to bond together the separate styrofoam sections joined to form the elongated seat 34.

The manner in which the boat is formed and assembled should be apparent from the foregoing description, but will be briefly summarized. The top and bottom foam sheets 12 and 14 are shaped and formed with openings as described, and as illustrated in FIG. 3, including the channel formed in the top surface of the sheet 14 to receive the pipe frame. The material removed to form openings 16, 18 and 18', are configured and pieces from openings 18 and 18' are combined to form seat 34. The pipe frame is then formed and assembled from cut pipe sections and the various connectors. The top connecting pipe sections 62 for the oarlocks are not assembled at that time. Holes are drilled in the top sheet 12 to accommodate pipes 60 and the canopy pipes or sleeves 80.

The elastic bonding material is then applied to the top surface of the bottom sheet 14 or the bottom surface of the top sheet 12, or both. The top and bottom sheets are then aligned, with the pipes 60 and 80 extending upwardly through openings formed therefor in the top sheet 12. The sheets are then bonded together. The seats, motor mount and trim strips around the oarlocks are then assembled by bonding. The boat is then laid on a flat surface and weight preferably applied to all bonded surfaces and the bonding material allowed to dry. After drying, the oarlock assembly is completed by assembling the connector 62 and elbows 46, and any desired metal trim around the edges of the openings 16 and 18–18' applied. After drying, any further detail work such as final bevelling of edges can be attended to, and any defects of the styrofoam incurred during the construction process can be repaired by the use of PL 300.

Following complete bonding, the boat is turned bottom up to expose the bottom for application of Ice and Water Shield 80 to the bottom surface of the boat, with the shielding material extending upwardly into the openings 18, 18', and upwardly over the aides of the bottom styrofoam sheet 14.

Figure 5:
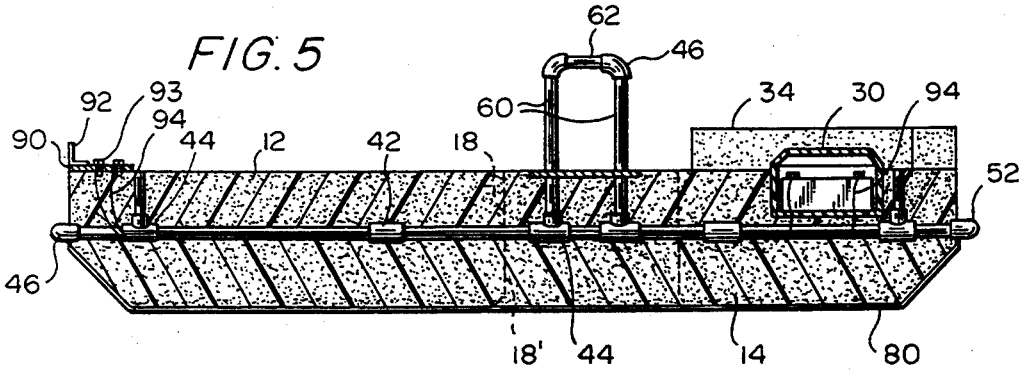
FIG. 5 is a sectional view similar to FIG. 4 but showing a modified boat construction specifically designed as a one man boat.
Figure 6:
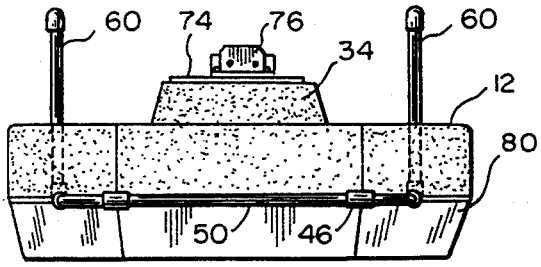
FIG. 6 is an end view looking at the bow end of the boat.
Figure 7:
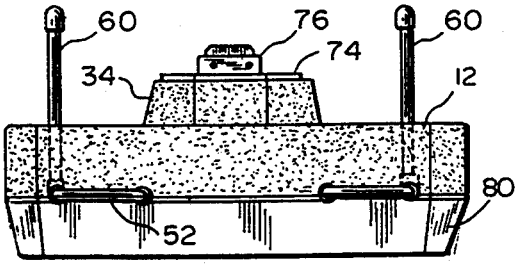
FIG. 7 is an end view looking at the stern of the boat.

After application of the bottom shielding material, the boat is again turned upright and a protective coating is preferably applied to all exposed areas on the top half of the boat, including the seating areas. The protective coating is preferably Pitt Flex, which can be applied either by a textured roller or by spraying. After applying and curing the coating, a chafe strip comprised of the same shielding material can be applied at the aide edges of the boat to provide protection that area. Preferably, the chafe strips are applied where the shielding material terminates at the upper side areas of the boat, generally in the vicinity of the top surface of the bottom sheet 14. The visible pipe frame work at the bow and stern of the boat, and the exposed pipes which form the oarlocks are preferably coated with a water based spray paint of the desired color, thereby providing protection and decor. The exposed wood pieces are likewise provided with sealers and protective coatings The boat thus far described is specifically designed to accommodate an operator and a passenger. With appropriate and relatively minor changes, the boat can be modified for one person usage, as illustrated in FIG. 5. In such event, the front storage compartment 26 illustrated in the FIG. 1 form is eliminated, with a motor mount platform 90 instead being secured to the top sheet 12 at the bow of the boat. A motor bracket 92 is mounted on the platform 90 for mounting the trolling motor (not shown). Wiring bolts 92 are mounted on the base 90, with wires 94 interconnecting the wiring bolts with the battery. The wires 94 can conveniently be positioned in the channel formed in the top surface of the bottom sheet 14 to receive the PVC pipe frame, prior to assembling the pipe framework and the sheets.

The central openings 18, 18' are similarly formed in both the top and bottom sheets 12 and 14, respectively, but the opening 16 for the passenger is eliminated. This provides a fairly large flat area between the openings 18, 18' and the bow of the boat. This provides the boatman with more leg room and what effectively is a casting deck, and permits easy access to the trolling motor if used.

The one man boat illustrated in FIG. 5 is otherwise constructed the same as the two man boat previously described, and the method of manufacture and assembly is the same except where indicated.

It will thus be seen that the lightweight boat construction in accordance with the present invention is lightweight and buoyant, is formed of inexpensive commercially available materials, and can be quickly and easily constructed and assembled. The boat has all the necessary features of a typical fishing boat, and there is provision for manual propulsion or motor propulsion. Moreover, the oarlocks provided for propulsion by oars at the same time provide a means by which the lightweight boat can be carried through shallow water or other non-navigable areas. The boat can be modified to a carrying mode by simply removing the crate which functions as the user's footwell, thereby exposing aligned openings extending through both the top and bottom sheets of styrofoam. The basic boat construction is designed for the operator and a passenger, although with slight modification, the boat can be advantageously designed for single person usage.

What is claimed is:

1. Boat construction, comprising a bottom sheet of lightweight floatable plastic material, a top sheet of lightweight floatable plastic material, said bottom and top sheets being configured externally to provide the desired external boat configuration when said top sheet is positioned contiguously over said bottom sheet, one of said bottom and top sheets being formed with a frame-receiving channel in a surface thereof contiguous the other sheet, frame means mounted in said channel for stabilizing and reinforcing the boat construction, means for sealably securing the contiguously disposed sheets to each other to form the completed boat, and wherein said bottom and top sheets are formed with aligned openings extending through the full thickness of both sheets, and further including a crate removably mounted in the aligned openings to receive the feet of the user of the boat, said crate when removed serving to expose said openings for positioning therein by the user to facilitate carrying the boat.

2. The boat construction of claim 1 further including first and second seats mounted on the upper surface of said top sheet in front of and behind said aligned openings, and further including a second opening formed in said top sheet, and a second crate mounted therein to serve as a footwell for a passenger sitting on said second seat.

3. The boat construction of claim 1, wherein said frame means comprises a plurality of PVC pipe sections, said pipe sections being interconnected to form a reinforcing frame extending longitudinally in said channel adjacent the opposite sides of the boat, and extending transversely in the channel in the regions intermediate the bow and stern of the boat.

4. The boat construction of claim 3, wherein said PVC pipe frame includes a section exposed outwardly of the bow of the boat to serve as a handle and protective guard, and sections disposed outwardly of the stern of the boat to serve as a handle and protective guard.

5. The boat construction of claim 3, wherein said PVC pipe frame includes pipe sections extending upwardly from the upper surface of the top sheet of plastic material, and a top connecting section interconnecting the upward extending pipe sections to form an oarlock at each side of the boat adjacent the aligned openings of the bottom and top sheets.

6. The boat construction of claim 1, including first and second seats mounted on and extending upwardly from the upper surface of the top sheet of plastic material, to the front of and behind said aligned openings, thereby to accommodate a passenger and the user, respectively, and wherein said second seat is provided with a motor mount adjacent the stern of the boat for mounting a motor for propelling the boat.

7. The boat construction of claim 1, wherein said means for sealably securing the contiguously disposed top and bottom sheets comprises resin bonding material, and further including a sheet of shielding material bonded to the bottom and side surfaces of the bottom sheet of plastic material to protect the boat from ice and water damage.

8. The method of manufacturing and assembling a lightweight boat formed primarily of plastic foam material, comprising the steps of:

providing separate top and bottom sheets of floatable plastic material, and configuring said sheets to the desired exterior configuration of the boat, said sheets having contiguous surfaces when the sheets are assembled;

removing material from said top sheet of plastic material to form first and second openings extending entirely therethrough;

forming an opening in said bottom sheet of lightweight material aligned with said second opening formed in said top sheet;

securing said material removed from said openings to the top surface of said top sheet of plastic material to form a pair of seats, one such seat being a passenger seat located between said first and second openings, and the second seat being located between said second opening in said top sheet of material and the stern of the boat;

forming a channel in the contiguous surface of at least one of said bottom and top sheets;

assembling a PVC pipe frame adapted to extend longitudinally and transversely of the boat for reinforcing and stabilizing the same;

inserting said PVC pipe frame into said channel, the depth of said channel being such that said channel entirely accommodates said framework without said framework extending above said contiguous surface of the sheet in which the channel is formed;

applying bonding adhesive to at least one of said contiguous surfaces, and disposing said top sheet over said bottom sheet so that said contiguous surfaces to be bonded are engaged, and setting said bonding adhesive thereby to form an integral boat construction in which said PVC frame is embedded.

* * * * *